United States Patent [19]

Tsilibes

[11] 3,981,577

[45] Sept. 21, 1976

[54] OPTICAL SYSTEM FOR AN ELECTROPHOTOGRAPHIC PRINTING MACHINE

[75] Inventor: George N. Tsilibes, Rochester, N.Y.

[73] Assignee: Xerox Corporation, Stamford, Conn.

[22] Filed: Sept. 18, 1974

[21] Appl. No.: 507,169

[52] U.S. Cl. ..... 355/4; 353/97; 355/8; 355/71

[51] Int. Cl.[2] ..... G03G 15/30

[58] Field of Search ..... 355/3 R, 4, 8, 11, 17, 355/18, 19, 35, 40, 67, 71, 74; 353/97, 85, 101

[56] References Cited

UNITED STATES PATENTS 1,676,600 7/1928 Capstaff ..... 355/71

3,105,425 10/1963 Cerasani et al. ..... 355/11 X

*Primary Examiner*—L. T. Hix

*Assistant Examiner*—Kenneth C. Hutchinson

*Attorney, Agent, or Firm*—H. Fleischer; C. A. Green; J. J. Ralabate

[57] ABSTRACT

An optical system in which the non-linearities in a light image are corrected. The optical system includes an opaque, movable belt having a plurality of slits therein. Each slit is of a different area with the width thereof increasing from the central region to the marginal regions thereof. The belt is moved to position a pre-selected slit in the optical light path substantially correcting the non-linearities in the light image.

5 Claims, 3 Drawing Figures

OPTICAL SYSTEM FOR AN ELECTROPHOTOGRAPHIC PRINTING MACHINE

BACKGROUND OF THE INVENTION

This invention relates generally to an electrophotographic printing machine, and more particularly concerns an improved optical system for utilization therein.

In the process of electrophotographic printing, a photoconductive surface is uniformly charged. The charged photoconductive surface is irradiated with a light image of an original document. The light image projected onto the charged photoconductive surface selectively discharges the charge to record an electrostatic latent image thereon. During development, toner particles are electrostatically attracted to the latent image rendering it visible. Subsequently, the toner powder image is transferred from the photoconductive surface to a sheet of support material. The powder image is permanently affixed to the sheet of support material producing a copy of the original document thereon. The foregoing process is described in greater detail in U.S. Pat. No. 2,287,691 issued to Carlson in 1942.

Multi-color electrophotographic printing is substantially the same as the heretofore discussed process. The principle distinction resides in that the optical system forms successive filtered light images of the original document rather than a total light image. The filtered or single color light image expose the charged photoconductive surface to create a single color electrostatic latent image thereon. The single color electrostatic latent image is developed with toner particles complementary in color thereto. The resulting single color toner powder image is transferred from the electrostatic latent image to a sheet of support material. This process is repeated a plurality of cycles with differently colored light images and their respective complementarily colored toner particles. Each single color toner powder image is transferred to the sheet of support material in superimposed registration with the prior toner powder image. In this manner, a multi-layered toner powder image is produced on the sheet of support material which after being permanently affixed thereto forms a color copy.

In all of the foregoing processes, the density of toner powder images is dependent upon the difference in voltage between the development system and the electrostatic latent image. Toner particles are attracted to those areas of the photoconductive surface having a voltage thereon greater than that of the development system. The areas of the photoconductive surface which are irradiated by the light image are discharged. The degree of discharge is dependent upon the intensity of the light image impinging thereon. Hence, it is highly desirable to provide a light image which is representative of the original document rather than having errors therein due to light ray non-linearities.

It is well known that the illumination at an image point is in proportion to the $\cos^4$ of the solid angle between the illumination point and the image point. Thus, it can be seen that the illumination on a photoconductive surface will fall off quite rapidly as the solid angle increased. Various approaches have been devised to compensate for this effect. Typically, a sheet of opaque material having a butterfly slit therein is employed. The area of the slit is inversely proportional to the illumination profile. Heretofore, the optical system employed only one exposure slit. Frequently, it is necessary to calibrate the printing machine by utilizing a plurality of exposure slits to optimize the copy produced thereby. Successive exposure slits are inserted into the machine during the calibration process. This permits determination of the optimum exposure slit. Once the optimum exposure slit is determined, it is inserted in the machine and remains there for the duration of operation or, until a subsequent calibration is required. To achieve the foregoing, a plurality of exposure slits are generally stored loosely within the machine cabinet. Occassionally, these loosely stored exposure slits are lost and must be replaced. After extended usage, the exposure slits may become dirty and may have to be replaced. In addition, the printing machine may require re-calibration after a period of time to correct for the aging of the light source. Thus, it would be highly desirable to have a plurality of readily interchangeable exposure slits integral with the optical system of the electrophotographic machine.

Accordingly, it is a primary object of the present invention to improve the optical system of an electrophotographic printing machine by incorporating therein a plurality of readily interchangeable exposure slits.

SUMMARY OF THE INVENTION

Briefly stated, and in accordance with the present invention, there is provided an optical system which substantially corrects the non-linearities in a light image of an original document.

Pursuant to the features of the present invention, the system includes a light source adapted to illuminate the original document with light rays. Lens means, in a light receiving relationship with the light rays transmitted from the original document form a light image thereof. A plurality of light attenuating members are disposed in the optical system. Each of the light attenuating members is adapted to correct the intensity of the light image for non-linearities therein. Moving means position a preselected one of the light attenuating members into the optical path of the light image.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and broad scope of the invention as defined by the appended claims.

DETAILED DESCRIPTION OF THE INVENTION

Figure 1:
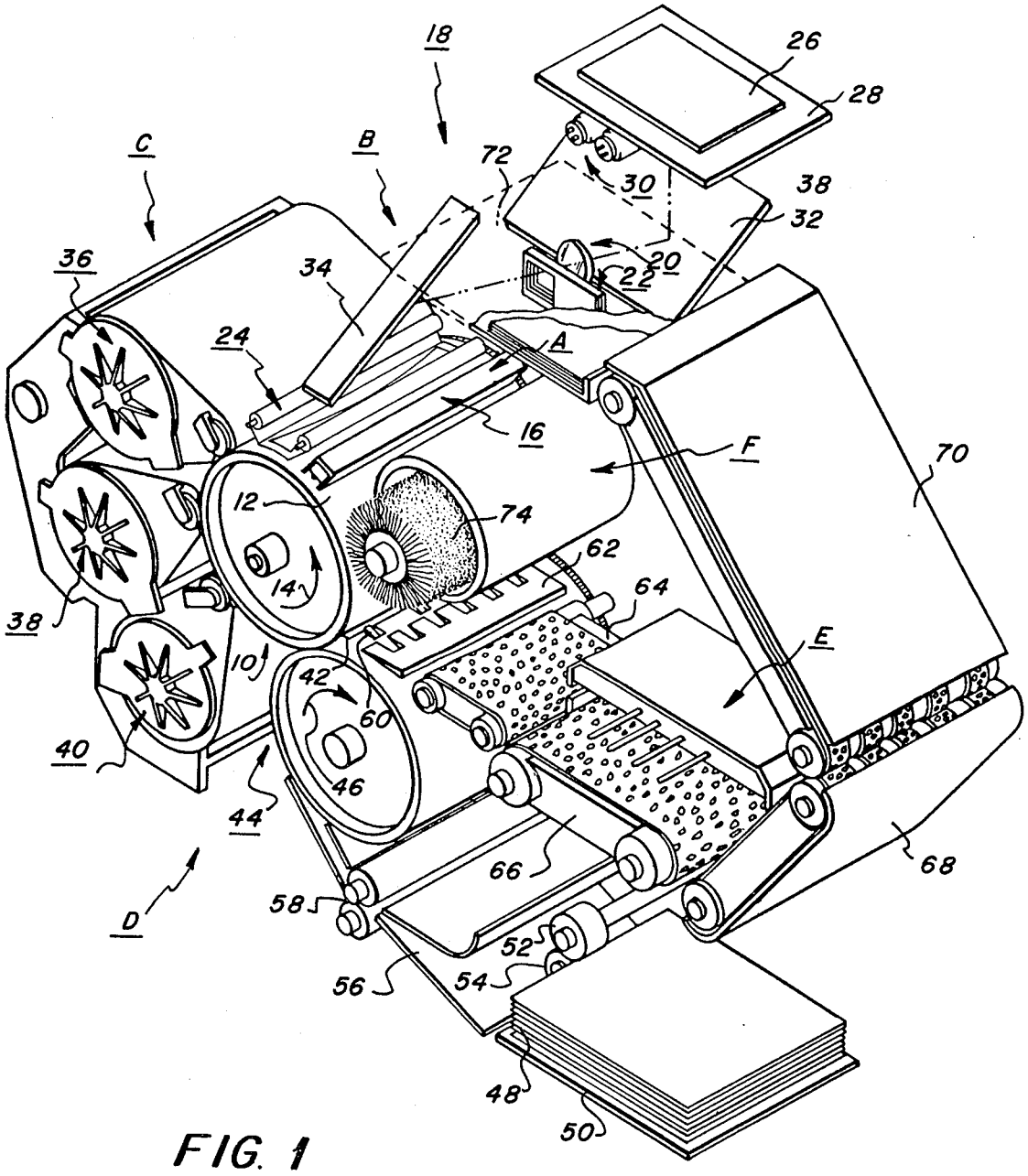
FIG. 1 is a schematic perspective view of an electrophotographic printing machine incorporating the features of the present invention therein.

With continued reference to the drawings wherein like reference numerals have been used throughout to designate like elements, FIG. 1 schematically depicts an electrophotographic printing machine. The depicted printing machine illustrates the various components utilized to produce colored copies from a colored original document. Although the optical system of the present invention is particularly well adapted for use in an electrophotographic machine, it will become evident from the following description that it is equally well suited for use in a wide variety of printing machines and is not necessarily limited to the particular embodiment shown herein.

Electrophotographic printing machines employ a drum 10 mounted rotatably within the machine frame (not shown). Drum 10 has a photoconductive surface 12 secured to and entrained about the exterior circumferential surface therof. One type of suitable photoconductive material is described in U.S. Pat. No. 3,655,377 issued to Sechak in 1972.

A series of processing stations are positioned about the periphery of drum 10. As drum 10 rotates in the direction of arrow 14, photoconductive surface 12 passes sequentially through each processing station. A timing disc is mounted in the region of one end of drum 10 and triggers the logic circuitry of the printing machine. This coordinates the various machine operations with one another to produce the proper sequencing of events of each processing station.

Drum 10, initially, moves photoconductive surface 12 through charging station A. At charging station A, a corona generating device, indicated generally at 16, extends in a longitudinal direction transversely across photoconductive surface 12. Corona generating device 16 charges photoconductive surface 12 to a relatively high substantially uniform level. Preferably, corona generating device 16 is of a type described in U.S. Pat. No. 2,778,946 issued to Mayo in 1957.

After photoconductive surface 12 is charged, drum 10 rotates to exposure station B. Exposure station B includes the optical system of the present invention, generally designated by the reference numeral 18 thereat. Optical system 18 includes a moving lens system generally designated by the reference numeral 20, a color filter, shown generally at 22, and a light ray attenuating member, shown generally at 24. An original document 26 is placed face down upon transparent viewing platen 28. Lamps 30 are located beneath transparent viewing platen 28 so as to illuminate original document 26. Lamps 30, lens 20 and filter 22 move in a timed relation with drum 10 to scan successive incremental areas of document 26 disposed upon platen 28. Mirror 32 reflects light rays transmitted from original document 26 through lens 20 forming an unattenuating light image. The unattenuated light image is transmitted through filter 22, i.e., a selected color separation filter inserted into the path of the light rays. Thereafter, the unattenuated single color light image is reflected from a second mirror 34 through attenuator member 34. The intensity of the light rays transmitted from attenuator member 34 decreases lengthwise incrementally inwardly from the marginal regions to the central region. This is achieved by employing an opaque member having a butterfly slit therein. The detailed structural configuration of light attenuating member 24 will be described in greater detail hereinafter with reference to FIGS. 2 and 3. After passing through attenuator member 24, the attenuated light image illuminates charged photoconductive surface 12. The irradiated areas of photoconductive surface 12 have the charge thereon selectively dissipated to record a single color electrostatic latent image thereon. As heretofore indicated, the appropriate color filter operates on the light image to record an electrostatic latent image on photoconductive surface 12 corresponding to a preselected spectral region of the electromagnetic wave spectrum, hereinafter referred to as a single color electrostatic latent image. The detailed structural configuration of optical system 18 will be discussed in greater detail with reference to FIG. 2.

Turning once again to FIG. 1, after photoconductive surface 12 is exposed, drum 10 rotates the single color electrostatic latent image recorded thereon to development station C. Development station C includes three individual developer units, generally indicated by the reference numerals 36, 38 and 40, respectively. Preferably, the developer units are all of a type generally referred to in the art as magnetic brush developer units. A typical magnetic brush developer unit employs a magnetizable developer mix of carrier granules and toner particles. The developer mix is continually brought through a directional flux field to form a brush thereof. Each developer unit includes a developer roll electrically biased to the appropriate potential such that toner particles are attracted from the carrier granules to the areas of photoconductive surface 12 having a greater charge thereon, i.e., the single color electrostatic latent image. The single color electrostatic latent image recorded on photoconductive surface 12 is developed by bringing the brush of developer mix into contact therewith. Each of the respective developer units contain discretely colored toner particles corresponding to the complement of the spectral region of the wave length of light transmitted through filter 22, e.g., a green filtered electrostatic latent image is rendered visible by depositing green absorbing magenta toner particles thereon. Similarly, blue and red latent images are developed with yellow and cyan toner particles, respectively. A suitable development system is described in copending application Ser. No. 255,259, filed in 1972, now U.S. Pat. No. 3,854,449, the diclosure of which is hereby incorporated into the present application.

Drum 10 is next rotated to transfer station D where the toner powder image adhering electrostatically to photoconductive surface 12 is transferred to a sheet of support material 42. Support material 42 may be plain paper, or a sheet of transparent, thermoplastic material. A transfer roll, shown generally at 44, rotates support material 42 in the direction of arrow 46. Transfer roll 44 is electrically biased to a potential of sufficient magnitude and polarity to electrostatically attract toner particles from photoconductive surface 12 to support material 42. U.S. Pat. No. 3,612,677 issued to Langdon et al. in 1972, describes a suitable electrically biased transfer roll. Transfer roll 44 is arranged to rotate in synchronism with drum 10, i.e. transfer roll 44 and drum 10 rotates at substantially the same angular velocity and have substantially the same diameter. Inasmuch as support material 42 is secured releasably to transfer roll 44 for movement therewith in a recirculating path, successive toner powder images may be transferred from photoconductive surface 12 to support material 42, in superimposed registration with one another. In this manner, a multi-layered toner powder image is formed on support material 42.

With continued reference to FIG. 1, the sheet feeding path for advancing sheets of support material 42 to transfer roll 44 will be briefly described. A stack 48 of sheets is supported on tray 50. Feed roll 52, in inoperative communication with retard roll 54, advances successive uppermost sheets of support material 42 from stack 48 into chute 56. As the uppermost sheet of support material 42 advances through chute 56 it passes into the nip of register rolls 58. Register rolls 58 align and forward the advancing sheet of support material 42. Gripper fingers 60, on transfer roll 44, secure the leading marginal edge of the advancing sheet of support material 42 thereto. In this manner, support material 42 rotates on transfer roll 44. After substantially all of the discretely colored toner powder images have been transferred to support material 42, gripper fingers 60 space support material 42 from transfer roll 44. This enables stripper bar 62 to be interposed between support material 42 and transfer 44 separating support material 42 therefrom. After support material 42 is stripped from transfer roll 44, it is moved on endless belt conveyor 64 to fixing station E.

At fixing station E, a suitable fuser, indicated generally by the reference numeral 66, heats the multi-layered powder image to affix it substantially permanently to support material 42. A typical fuser is described in U.S. Pat. No. 3,498,592 issued to Moser in 1970. After the multi-layered toner powder image is affixed to support material 42, endless belt conveyors 68 and 70 advance support material 42 to catch tray 72. Catch tray 72 is positioned such that the machine operator is readily able to remove the final multicolored copy from the printing machine.

Returning to the remaining processing station disposed about the periphery of drum 10, invariably some residual toner particles remain on photoconductive surface 12 after the transfer of the powder image therefrom to support material 42. These residual toner particles are removed from photoconductive surface 12 as it passes through cleaning station F. At cleaning station F, a cleaning corona generating device (not shown) neutralizes the electrostatic charge remaining on the residual toner particles and photoconductive surface 12. Th neutralized toner particles are then removed from photoconductive surface 12 by rotatably mounted brush 74 in contact therewith. A suitable brush cleaning device is described in U.S. Pat. No. 3,590,412 issued to Gerbasi in 1971.

It is believed that the foregoing description is sufficient for purposes of the present application to illustrate the general operation of an electrophotographic printing machine embodying the teachings of the present invention therein.

Figure 2:
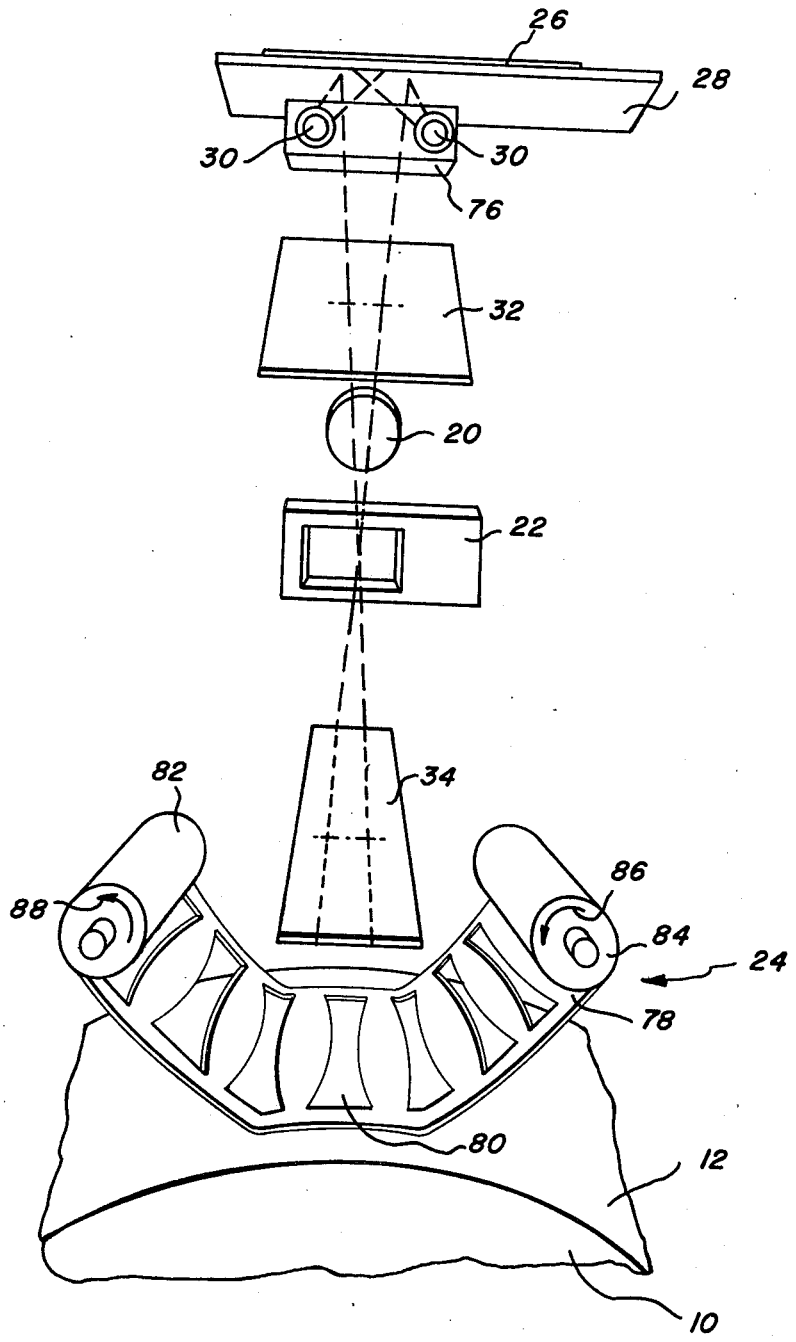
FIG. 2 is a schematic perspective view of the FIG. 1 printing machine optical system.

Referring now to FIG. 2, optical system 18 is depicted therein in detail. Optical system 18 includes lamp carriage 76 supporting a pair of light sources or lamps 30 thereon. Lamp carriage 76 is arranged to traverse platen 28 illuminating incremental widths of original document 26 disposed thereon. A cable pulley system driven by the motor (not shown) rotating drum 10 moves lamp carriage 76. As lamp carriage 76 traverses platen 28, another cable pulley system acts to move lens 20 at a correlated speed therewith on suitable rolls surrounding a shaft (not shown). Filter assembly 22 is mounted by suitable brackets on lens 20 to move in conjunction therewith. Attenuator member 24 is mounted on the machine frame being interposed between mirror 34 and photoconductive surface 12. Lens 20 and filter 22 scan original document 26 to create a flowing unattenuated light image thereof. This light image is transmitted through attenuator member 24. Upon reaching the end of scan path of platen 28, lens 20 and filter 22 are spring biased to return to to return to their original position to again scan platen 28 for the start of a new cycle. It is evident that the movement of lens 20, filter 22 and lamps 30 are correlated with the speed of rotation of drum 10. For greater details regarding the drive system of optical system 18, reference is made to U.S. Pat. No. 3,062,109 issued to Mayo et al. in 1962, the relevant portions of the disclosure being hereby incorporated in the present application.

Preferably, lens 20 is a six element split dagor type of lens having front and back compound lens components with a centrally located diaphragm therebetween. Lens 20 forms a high quality image with a 31° field of angle, an f/4.5 speed and a 1:1 magnification. In addition, lens 20 is designed to minimize the effect of secondary color at the image plane. The front lens component has three lens elements including, in the following order: a first lens element of positive power, a second lens element of negative power cemented to the first lens element, and a third lens element of positive power disposed between the second lens element and diaphragm. The back lens component also has three similar elements positioned so that lens 20 is symmetrical. In the specific embodiment of the lens, the first lens element of the front component is a double convex lens, the second lens element being a concave lens and the third lens element being a convex-concave lens element. For greater details regarding lens 20, reference is made to U.S. Pat. No. 3,592,531 issued to McCrobie in 1971, the pertinent portions thereof being hereby incorporated into the present application.

Filter 22 comprises a housing which is mounted on lens 20 by a suitable bracket and moves with lens 20 during scanning as a single unit. The housing of filter 22 includes a window which is positioned relative to lens 20 to allow light reflected from original document 26 on platen 28 to pass therethrough to attenuator member 24. The bottom and top walls of the housing member include a plurality of tracks which extend the entire width thereof. Each track is adapted to carry a filter in a manner to permit movement of the filter from an inoperative position to an operative position. In the operative position, the filter is interposed in the window of the housing permitting the light rays to pass therethrough. The individual filters are mounted in a frame and made of any suitable filter material, i.e., coated glass. Three filters are employed in the FIG. 1 electrophotographic printing machine. The filters are resiliently urged into the window of the housing member by individual extension springs. When inoperative, the filters are retained out of line of the housing window by means of a stop pin which extends up through an opening in the bottom of the housing member into the respective track of each filter. A solenoid in association with each stop pin retains the filters in the inoperative position. A selected filter is inserted into the optical path of the housing window by activating the solenoid to move the stop pin downwardly out of the path of the selected filter, thereby allowing the spring associated therewith to move the filter into the optical light path of the housing window. Each filter remains in a housing window throughout the entire scanning of the original document. A suitable filter mechanism is described in U.S. Pat. No. 3,775,006 issued to Hartman et al. in 1973, the relevant portions of that disclosure being hereby incorporated into the present application.

While the filter of the present invention has been described as requiring a housing member with a window and a spring associated with solenoids to control the movement thereof, one skilled in the art will appreciate that the invention is not necessarily so limited. Any suitable filter mechanism having the requisite number of filters therein my be employed in conjunction with lens 20 and attenuator member 24.

Preferably, filter mechanism 22 includes a blue filter, a red filter, and a green filter. Each of the filters is associated with the respective toner particles, i.e., the complement of the color thereof so as to produce a subtractive system. As heretofore indicated, a green filtered light image is devleoped with magenta toner particles, a blue filtered light image is developed with yellow toner particles and a red filtered light image is developed with cyan toner particles.

Turning now to a brief discussion of lamps 30, preferably, each lamp includes three phosphors. The phosphors within lamp 30 have a blue/green ratio preferably of about 0.3, and the blue output being about 25 microwatts/centimeter$^2$. Lamps 30 are energized at about 37 watts, 40 volts and 1½ amperes RMS. The exterior circumferential surface of each lamp 30 is opaque with a clear region extending over about a 45° arc. The clear region extends substantially along the entire length of the tubular configured lamp 30. Lamps 30 have peak energy outputs in the regions of the blue, green and red wave lengths. The corresponding filters are arranged to permit an unattenuated light image having a specific bandwidth to pass therethrough. Thus, a blue filter permits only an unattenuated light image in the blue region to be transmitted therethrough. Similarly, a red filter will only permit an unattenuated light image in the red region, and a green filter only an unattenuated light image in the green region. the unattenuated light image passing through filter 22 is transmitted to attenuator member 24.

Attenuator member 24 includes a belt 78 having a plurality of spaced butterfly slits therein. Belt 78 is entrained about spaced apart roller 82 and 84. Roller 84 is driven in the direction of arrow 86 to advance the appropriate slit 80 into the optical light path. In this way, belt 78 unrolls from roll 82 which, in turn, rotates in the direction of arrow 88. Belt 78 is interposed between mirror 34 and photoconductive surface 12. As shown in FIG. 2, belt 78 is spaced from photoconductive surface 12. A plurality of discretely sized butterfly slits are formed in belt 78. Preferably, belt 78 is formed from a substantially opaque, flexible material. By way of example, belt 78 may be a metallic foil material having a black coating deposited thereon.

Figure 3:
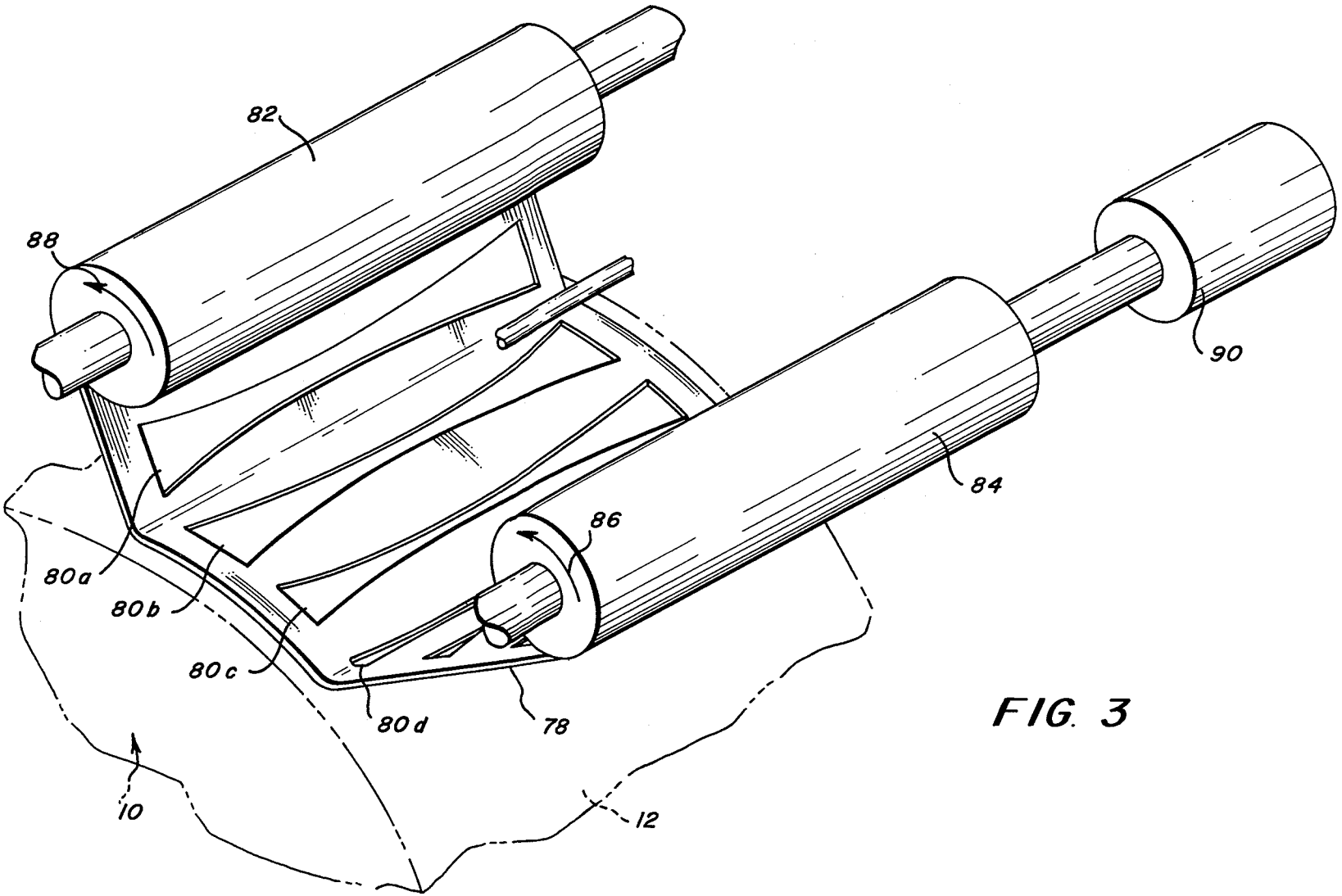
FIG. 3 is a schematic perspective view of the FIG. 2 light attenuating apparatus.

Turning now to FIG. 3, attenuator member 24 will be described in greater detail. Attenuator member 24 includes belt 78, preferably formed from a flexible opaque material. Belt 78 is entrained about roller 82 and unwinds therefrom in the direction of arrow 88. The other end portion of belt 78 is entrained about roller 84 and winds about roller 84 in the direction of arrow 86. As shown in FIG. 3, a plurality of butterfly slits are formed in belt 78. By way of example, butterfly slits 80*a* may have a maximum width in the marginal regions of 0.682 inches and a minimum width in the central region of 0.542 inches. Slit 80*b* has a maximum width in the marginal regions of 0.751 inches and a minimum width in the central region of 0.597 inches. Slit 80*c* has a maximum width in the marginal regions of 0.829 inches and a minimum width in the central region of 0.659 inches. Slit 80*d* has a maximum width in the marginal regions of 0.913 inches and a minimum width in the central region of 0.726 inches. In this manner, the appropriate exposure slit may be selected during calibration of the electrophotographic printing machine to substantially optimize the intensity of the light image transmitted to photoconductive surface 12. During calibration, stepping motor 90 is actuated to rotate roller 84 in the direction of arrow 86 advancing belt 78 in the direction of arrow 92. Movement of belt 78 in the direction of arrow 92 interposes one of the selected slits in the optical light path. Stepping motor 90 is arranged to advance belt 78 a discrete distance each time it is activated. In this manner, each exposure slit 80 is positioned in the optical light path. Thus, in operation, the operator advances a first exposure slit into the optical light path and reproduces a copy therewith. The copy is then compared to a master calibration sheet. The foregoing is repeated for successively different size exposure slits. The detailed calibration procedure is described in U.S. Pat. No. 3,799,668 issued to McVeigh in 1974, the relevant portions thereof being hereby incorporated into the present application.

In addition to employing variable size slits during the calibration process, different slits are used in the functional or pictorial mode of operation. Thus, in the pictorial mode of operation a slit having a maximum width of 0.682 inches in the marginal regions and a minimum width of 0.542 inches in the central would be employed. When in the functional mode, the stepping motor indexes the belt until a slit having a maximum width of 1.006 inches in the marginal regions and a minimum width of 0.8000 inches in the central region is in the optical path. This results in about a 45% increase in illumination.

While light attenuating member 24 has been described as being an belt having a plurality of butterfly slits therein of different sizes, it will be obvious to a man skilled in the art that many other techniques may be employed to achieve a similar end. By way of example, attenuator member 24 may include an opaque flexible belt formed from a plastic material having a plurality of spaced rectangular transparent sections therein. Each rectangular section has a thin film or optical coating deposited thereon. The density of this coating is a maximum in the central region and decreases toward the marginal regions thereof. The density of the coating decreases lengthwise from the central region in accordance with a Cos$^4$ curve. Thus, a variable density coating would simulate the butterfly slit hereinbefore described. Both of the foregoing arrangements would compensate for non-linearities introduced by the fact that the light source produces a Cos$^4$ error as hereinbefore described. Another arrangement would utilize a cassette or cartridge for housing the endless belt.

Exposure slit 80 is of a minimum width in the central region and of a maximum width in the marginal region. The curvature of exposure slit 80 is inversely proportional to the intensity of the light rays being emitted from the light source. Thus, the attenuated light image transmitted from exposure slit 80 will have substantially uniform intensity throughout its area. For example, it is well known that a light image has a maximum intensity in the central portion and decreases in accordance with the Cos$^4$ law from the central portion to the marginal portions thereof. The area of each exposure slit 80 is arranged inversely thereto. Each exposure slit 80 minimizes the amount of light transmitted in the central region and maximizes the amount of light transmitted in the marginal regions in accordance with the $Cos^4$ law. Thus, the light image transmitted from exposure slit 80 has a substantially uniform intensity.

While slit 80 on belt 78 has been described as being substantially flat, i.e. in a plane spaced from a tangential to drum 10, it may be curved. Thus, slit 80 may be arcuate having substantially the same curvature as drum 10.

As hereinbefore indicated, a plurality of exposure slits having differing sizes are positioned in the optical light path. In this way, the appropriate exposure slit may be selected during calibration and employed in operation. If subsequent calibration processes are required, the new exposure slit may be readily chosen from those formed on the belt. The foregoing may be employed to also compensate for the aging characteristics of the light source or for changing from the functional to pictorial modes of operation. Hence, an appropriate exposure slit may be judiciously selected which would optimize the amount of light impinging on the photoconductive surface. This system obviates the problem of storing loosely a plurality of differing size exposure slits in the printing machine. As previously noted, exposure slits stored in such a fashion are frequently lost or mislaid resulting in increased cost and great difficulties for the machine operator. In the present invention, the exposure slits are always available, the operator merely being required to activate a stepping motor to advance the appropriate slit into the optical light path.

In recapitulation, it is evident that the optical system utilized in the electrophotographic printing machine hereinbefore described acts to attenuate the light image transmitted to the photoconductive surface so as to correct for any nonlinearities in the light source. Moreover, a plurality of exposure slits are integral with the electrophotographic printing machine enabling the operator to readily calibrate the machine and select the appropriate exposure slit for use therewith. The foregoing reduces the complexity of calibration and prevents the loss or mislaying of any loose exposure slits.

While the optical system of the present invention has been described as being employed in a multi-color electrophotographic printing machine utilizing dry or powder toner, it is obvious to one skilled in the art that the invention is not necessarily so limited in its use. By way of example, the optical system may be employed in black and white electrophotographic printing machines or one using liquid development. A printing machine using liquid development is described in U.S. Pat. No. 3,008,115 issued to Gundlach in 1962. Similarly, the optical system may be used in a photoelectrophoretic imaging system. A polychromic photoelectrophoretic imaging system is described in U.S. Pat. No. 3,384,488 issued to Tulagin in 1968.

It is, therefore, apparent that there has been provided, in accordance with the present invention, an optical system that fully satisfies the objects, aims and advantages set forth above. While this system has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An optical system for forming a substantially uniform intensity light image of an original document, including:

a light source for illuminating the original document with light rays;

lens means in a light receiving relationship with the light rays transmitted from the original document to form a light image thereof;

an opaque belt member having a plurality of spaced slits therein, each of the slits in said belt member being of different areas and having the widths thereof increasing in a lengthwise direction from a central region to the marginal regions thereof;

means for movably supporting said belt member; and means for moving said belt member so as to position one of the slits in the optical path of the light image to correct the non-linearities of the light image transmitted thereto so as to transmit therefrom a light image having substantially uniform intensity.

2. A system as recited in claim 1, further including means for filtering the light image to produce a single color light image.

3. An electrophotographic printing machine for reproducing an original document, including:

a photoconductive member;

means for charging said photoconductive member to a substantially uniform level; and means for exposing said photoconductive member to a light image so as to selectively dissipate the charge to record thereon an electrostatic latent image of the original document, said exposing means comprising a light source for illuminating the original document with light rays, lens means in a light receiving relationship with the light rays transmitted from the original document to form a light image thereof, an opaque belt member having a plurality of spaced slits therein, each of the slits in said belt member being of different areas and having the width thereof increasing in a lengthwise direction from a central region to the marginal regions thereof means for movably supporting said belt member, and means for moving the belt member so as to position one of the slits in the optical light path of the light image to correct the non-linearities of the light image transmitted thereto so as to transmit to said photoconductive member a light image having substantially uniform intensity.

4. A printing machine as recited in claim 3, further including:

means for developing the electrostatic latent image recorded on said photoconductive member with toner particles;

means for transferring the toner particles to a sheet of support material, in image configuration; and means for fixing substantially permanently the toner particles to the sheet of support material.

5. A printing machine as recited in claim 4, further including means for filtering the light image so as to produce a single color light image.

* * * * *